US006196545B1

(12) United States Patent
Peeples

(10) Patent No.: US 6,196,545 B1
(45) Date of Patent: Mar. 6, 2001

(54) SIMPLE CHESS-TYPE BOARD GAME FOR TWO, THREE, AND FOUR PLAYERS

(76) Inventor: Robert R. Peeples, 449 Santa Fe Dr., PMB #143, Encinitas, CA (US) 92024

( * ) Notice: Subject to any disclaimer, the term of this patent is extended or adjusted under 35 U.S.C. 154(b) by 0 days.

(21) Appl. No.: 09/426,109

(22) Filed: Oct. 22, 1999

(51) Int. Cl.[7] ..... A63F 3/02

(52) U.S. Cl. ..... 273/260; 273/261; 273/258; 273/262

(58) Field of Search ..... 273/260, 261, 273/236, 255, 258, 262, 288

(56) References Cited

U.S. PATENT DOCUMENTS 1,405,988 * 2/1922 Erwin .
1,633,887 * 6/1927 Espitallier .
3,761,093 * 9/1973 Migliore .
3,871,657 * 3/1975 Lorenz .
4,067,578 * 1/1978 Chang .
5,275,414 * 1/1994 Stephens et al. .

* cited by examiner

*Primary Examiner*—Benjamin H. Layno
*Assistant Examiner*—Vishu Mendiratta

(57) ABSTRACT

A board game apparatus and method of playing a game with the apparatus by two, three, or four players is provided. The board game apparatus consists of a game board and four distinguishable playing sets, one for each player. The game board has only forty-nine squares, arranged as a grid of seven columns of squares by seven rows of squares. A playing set has only four playing pieces, one each of Alpha, Beta, Gamma, and Delta. Each playing piece is visually distinguishable from other playing pieces of the playing set, and each playing piece moves in a different manner: Alpha pieces move only one space each move, either laterally or diagonally; Beta pieces move one or two spaces, either laterally or diagonally; Gamma pieces move one or two spaces, laterally only; Delta pieces move one or two spaces, diagonally only. Players take turns, moving one of their playing pieces each turn with the object of capturing opponent's playing pieces. When an Alpha piece is captured, all playing pieces of that playing set are removed. A match is won when only one player's Alpha playing piece remains uncaptured.

2 Claims, 3 Drawing Sheets

SIMPLE CHESS-TYPE BOARD GAME FOR TWO, THREE, AND FOUR PLAYERS

BACKGROUND

1. Field of the Invention

This invention relates to board games, specifically to simplified chess-type board games.

BACKGROUND

2. Description of Prior Art

Chess is the most highly regarded abstract strategy board game because it allows players to create the most complex strategies. However, most board game enthusiasts do not play chess, citing the difficulties in mastering its complex rules of play and, especially, in coordinating playing sets that have sixteen playing pieces with six different manners of movement. Board game enthusiasts who object to the rigors of chess have long expressed a desire for a simple chess-type board game.

OBJECTS AND ADVANTAGES

Accordingly, several objects and advantages of the present invention are to provide a simple chess-type board game for two, three, or four players that is substantially simpler than chess, in that:

(a) the rules of play are very simple and require no knowledge of the rules of chess;

(b) a playing set has only four playing pieces; and (c) the playing pieces are not subject to the numerous rules governing the movement of playing pieces in standard chess.

Still further objects and advantages will become apparent from consideration of the ensuing description and drawings.

DRAWING FIGURES

In the drawings, closely related figures have the same number but different alphabetic suffixes.

REFERENCE NUMERALS IN DRAWINGS

10 game board

DESCRIPTION

FIGS. 1A to 1D and FIGS. 2 to 4

Preferred Embodiment

FIG. 1A to FIG. 1D illustrate, respectively, the preferred embodiment of the four playing pieces, Alpha, Beta, Gamma and Delta, of each playing set. Each playing piece is visually distinguishable from other pieces of the playing set. Also, in the preferred embodiment of the playing sets, all playing pieces of a playing set are of a same color that is different from the color used for pieces of other playing sets.

Figure 1A:
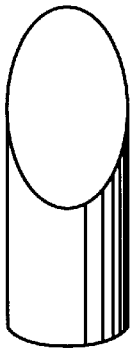
FIGS. 1A to 1D is an elevation view of the preferred embodiment of the four playing pieces comprising a playing set.
Figure 1B:
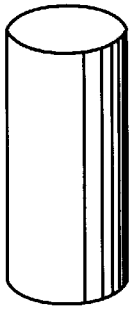
Figure 1C:
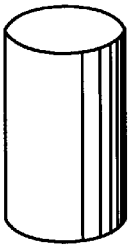
Figure 1D:
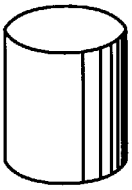
Figure 2:
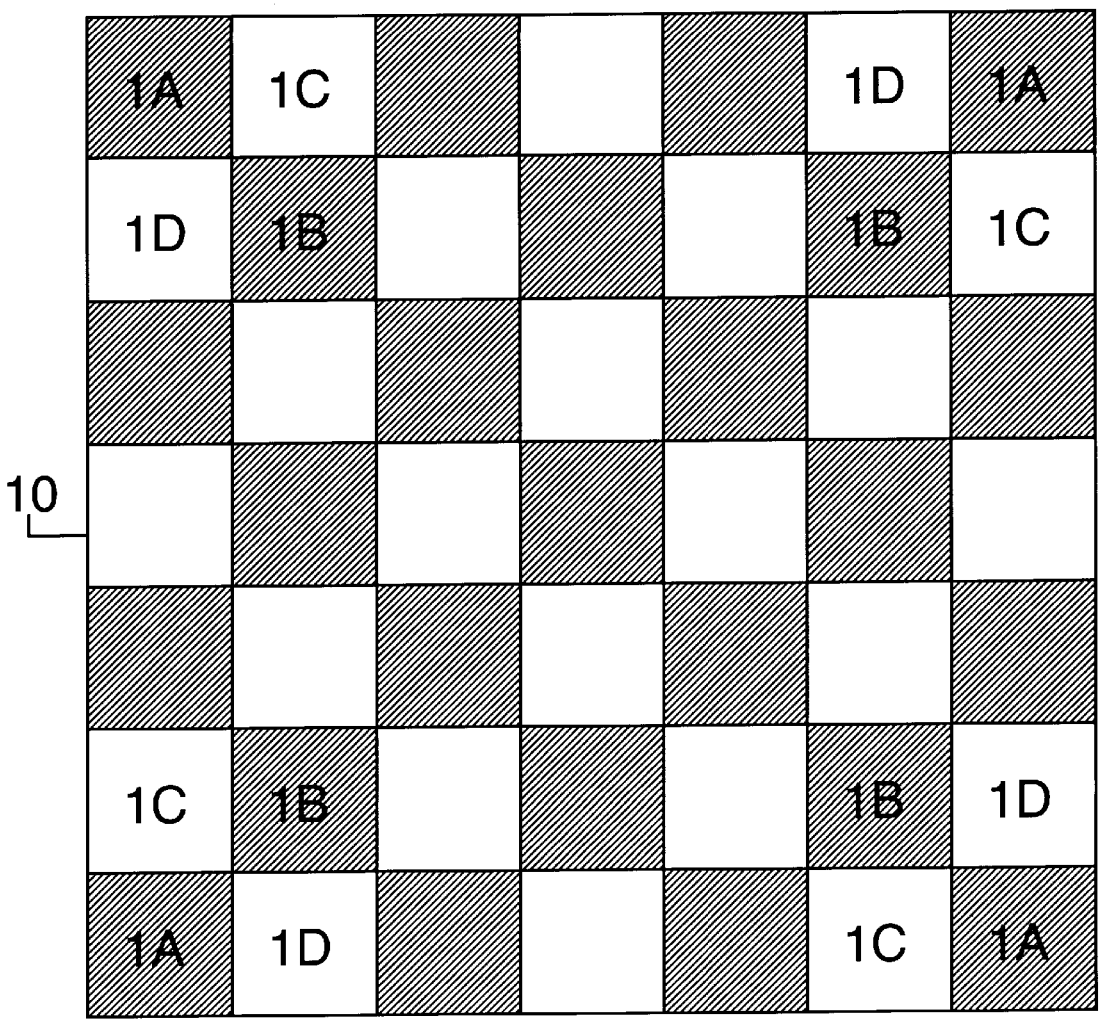
FIG. 2 is a plan view of the preferred embodiment of the game board 10, and four playing sets positioned at the begining of a match in which four players may play.

FIG. 2 illustrates the preferred embodiment of the present invention for the game board 10, and the placement of the playing pieces on the game board at the beginning of a match having four players. A game board is an equilateral grid of only forty-nine squares arranged as seven columns by seven rows. In the preferred embodiment, game board squares are alternately colored in a checkerboard pattern. Alpha, Beta, Gamma and Delta playing pieces are represented by their alphanumeric drawing numbers, respectively, 1A, 1B, 1C and 1D.

Figure 3:
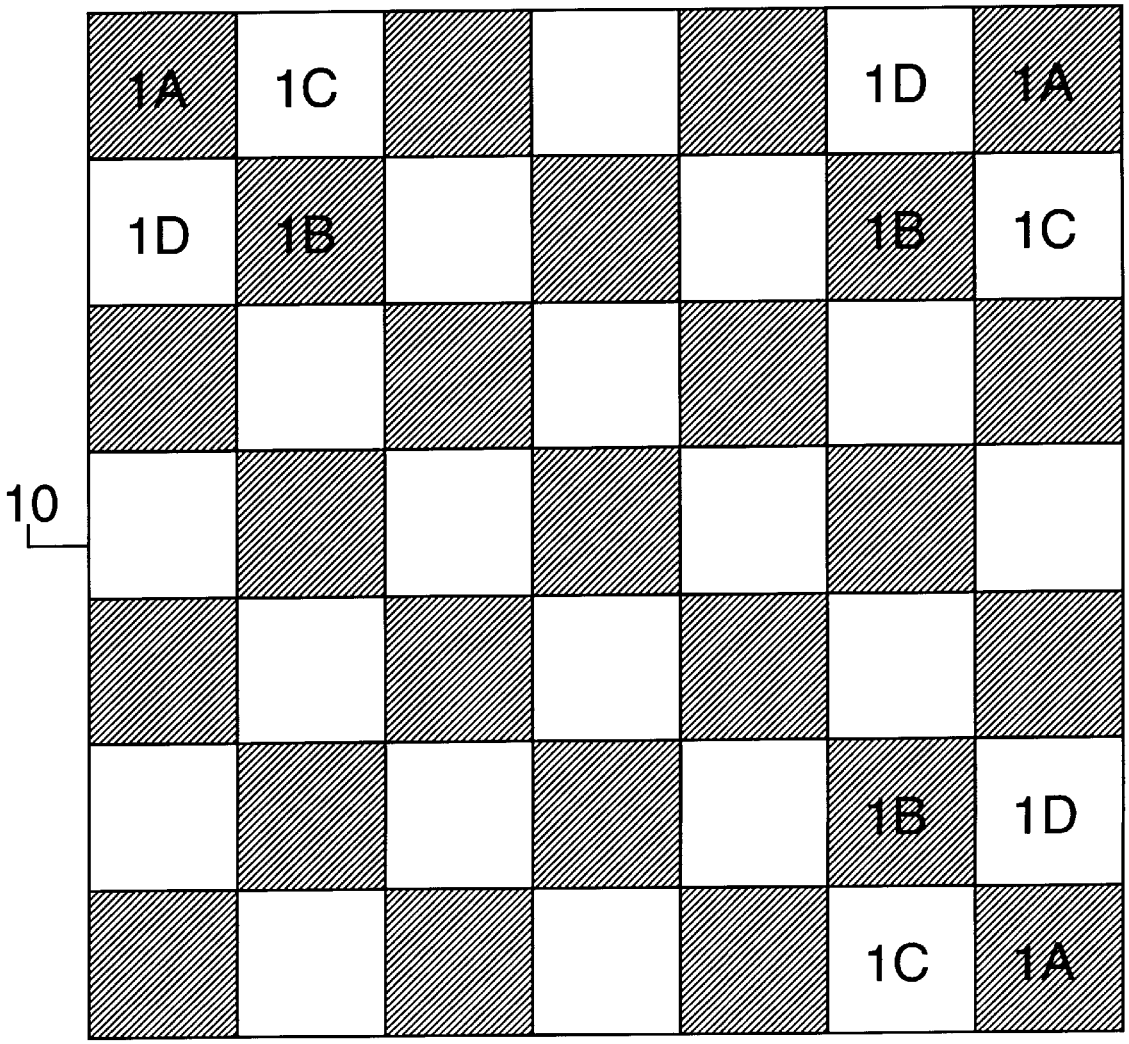
FIG. 3 shows three sets of playing pieces positioned on game board 10, at the begning of a match having three players.
Figure 4:
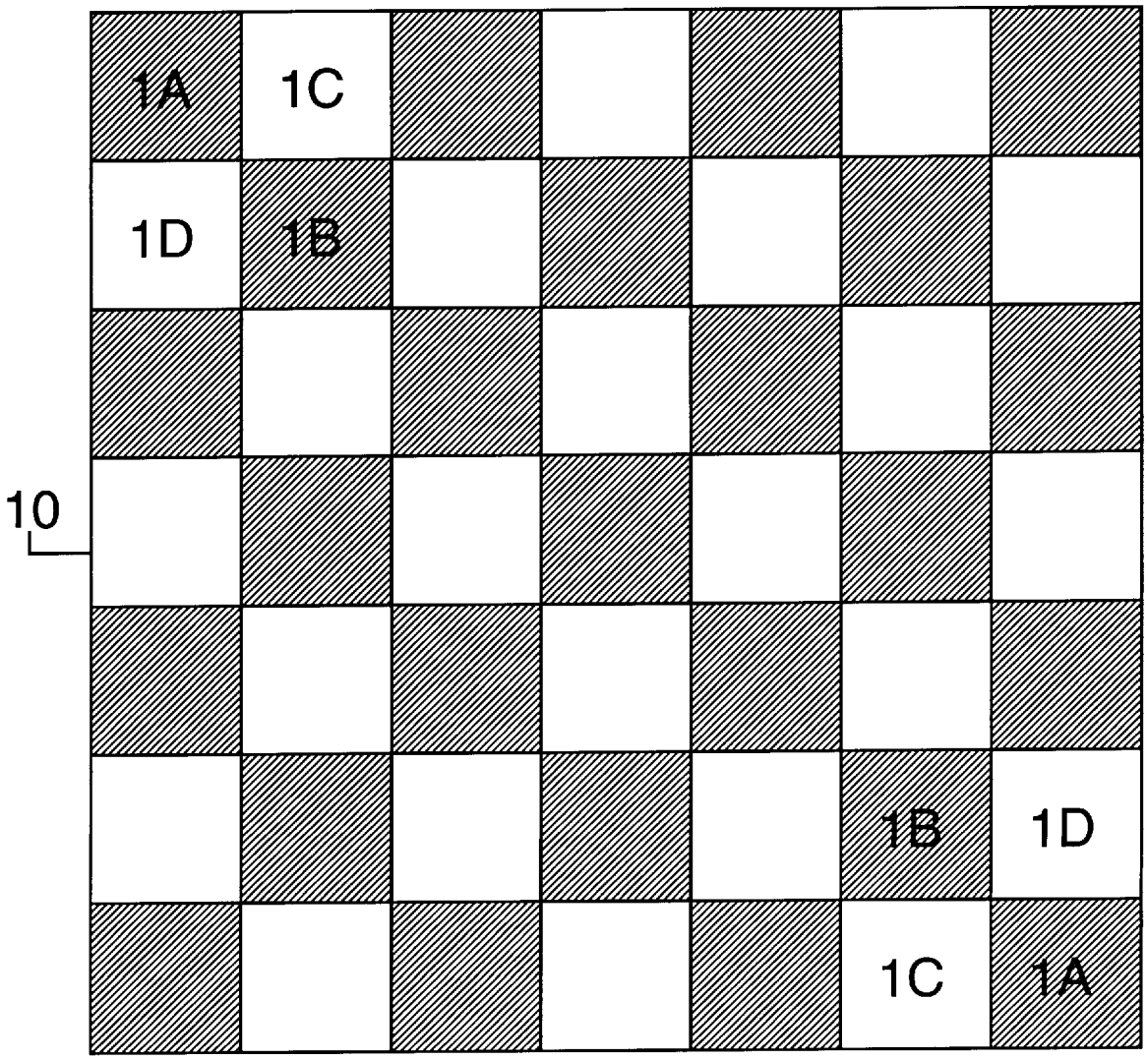
FIG. 4 shows two playing sets positioned on game board 10, at the beginning of a match having two players.

FIG. 3 and FIG. 4 illustrate the beginning dispositions of playing sets on game board 10 when the game is played by three players (FIG. 3), and two players (FIG. 4). Alpha, Beta, Gamma and Delta playing pieces are represented by their alphanumeric drawing numbers, respectively, 1A, 1B, 1C, and 1D.

OPERATION

To begin play, position a playing set for each player at a corner portion of game board 10, (as shown in FIG. 2 to FIG. 4) so that for each playing set:

(a) The Alpha playing piece occupies the most remote corner square of that corner portion of the game board; and (b) The Beta playing piece occupies the square that is diagonally adjacent to the Alpha playing piece; and (c) The Gamma playing piece occupies the square laterally adjacent to the left of the square occupied by the Alpha playing piece; and (d) The Delta playing piece occupies the square laterally adjacent to the right of the square occupied by the Alpha playing piece.

All playing pieces move only in straight lines, in any direction diagonally, and/or in any direction laterally. The term, "laterally", describes movement parallel to the rows and columns of squares of the game board. The specific movements for each playing piece are:

(a) Alpha playing pieces may be moved a maximum distance of one square each move, either laterally or diagonally;

(b) Beta playing pieces may be moved a maximum distance of two squares each move, either laterally or diagonally;

(c) Gamma playing pieces may be moved a maximum distance of two squares each move, laterally only; and (d) Delta playing pieces may be moved a maximum distance of two squares each move, diagonally only.

The objective of the players of the board game of the present invention is to be the last active player whose Alpha playing piece has not been captured. The players observe the following rules of play:

(1) A player may move one playing piece each turn of play.

(2) A playing piece may not jump over another playing piece.

(3) Any playing piece may capture any opponents'piece that is within the moving range of the capturing piece.

(4) To capture an opponent's piece, remove the captured piece from the playing board and move the capturing piece into the vacated square.

(5) To defeat a player, the player's Alpha piece must be captured. When an Alpha piece is captured, remove all the pieces of that playing set.

(6) When there are more than two players, a player may resign only at his or her turn to play. A resigned player's pieces remain immobile on the playing board and may be captured. When a resigned player's Alpha playing piece is captured, remove all playing pieces of that playing set.

(7) When there are two players, the players take turns moving. When there are more than two players, turn of play proceeds clockwise.

CONCLUSIONS, RAMIFICATIONS, AND SCOPE

Accordingly, the reader will see that my board game apparatus and method of play provide a chess-type board game for two, three, or four players that is substantially simpler than chess, in that:

(a) The rules of play are very simple and require no knowledge of chess. For example, there are no provisions for check, checkmate and stalemate;

(b) A playing set has only four playing pieces, rather than the sixteen playing pieces of a chess playing set, so that it is easy for players to coordinate their movements; and (c) The movements of the playing pieces are substantially simpler than those of chess in that all the pieces move only in straight lines, no more than two squares each move, with no optional manners of movement allowed. That is, unlike chess: no piece may move the entire width of the playing board in a single move; there are no chess Knight-type moves; there are no provisions for castling; no piece captures in a way that is different from its normal moving manner, or captures en passant; no piece can be promoted; no piece has optional initial moving distances.

Although the description above contains many specificities, these should not be construed as limiting the scope of the invention, but as merely providing Illustrations of some of the presently preferred embodiments of this invention. For example, any design may be used instead of the preferred embodiment for distinguishing the playing pieces; and four players may play independently or as two partnerships; and two players may begin play with their playing sets positioned at any two corners of the playing board.

Thus, the scope of the invention should be determined by the appended claims and their legal equivalents, rather than by the examples given.

I claim:

1. A board game apparatus consisting of:

a flat game board having forty-nine, and only forty-nine, unobstructed squares arranged as a grid of seven rows of squares by seven columns of squares; and four distinguishable playing sets, each said playing set having four, and only four, playing pieces, with each said playing piece being visually distinguishable from every other playing piece of said playing set, and each said playing piece having a manner of movement that is different from every other said playing piece in a said playing set.

2. A method of play whereby two, three, and four players may play a board game that consists of a flat game board having only forty-nine squares arranged as a grid of seven rows of squares by seven columns of squares, and four distinguishable playing sets, each said playing set having only four playing pieces, each said playing piece being visually distinguishable from every other playing piece of said playing set, the method of play consisting of:

designating one playing piece of each playing set as the Alpha playing piece, with movements limited to any lateral direction and any diagonal direction, a distance of no more than one square each move;

designating a second playing piece of each playing set as being the Beta playing piece, with movements limited to any lateral direction and any diagonal direction, a distance of no more than two squares each move;

designating a third playing piece of each playing set as being the Gamma playing piece, with movements limited to any lateral direction a distance of no more than two squares each move;

designating a fourth playing piece of each playing set as being the Delta playing piece, with movements limited to any diagonal direction a distance of no more than two squares each move;

prohibiting playing pieces from jumping over playing pieces;

allowing each player to control the movements of the four playing pieces of one playing set;

disposing a playing set for each player in a different corner portion of the game board, so that for each playing set;

the Alpha playing piece occupies the most remote corner square, the Beta playing piece occupies the square diagonally adjacent to the square occupied by the Alpha playing piece, the Gamma playing piece occupies the square laterally adjacent to the left of the square occupied by the Alpha playing piece, and the Delta playing piece occupies the square laterally adjacent to the right of the square occupied by the Alpha playing piece;

allowing each player, in turn, to move one playing piece of his or her playing set to any unoccupied square on the game board within the assigned capability of movement of the playing piece being moved;

allowing the players to use their playing pieces to capture any opponents' playing piece occupying a square within the assigned capability of movement of the playing piece being moved;

allowing the players to use their playing pieces to capture opponents' playing pieces by removing the captured playing pieces and placing the capturing playing pieces in the vacated squares;

allowing a player in a three-player or four-player match to resign only at his or her turn to play;

requiring the playing pieces of a resigned player to remain immobile on the game board and subject to capture until a winner of the match is declared removing all the playing pieces of a playing set when the Alpha playing piece of the playing set is captured;

winning the match by being the last active player whose Alpha playing piece has not been captured.

* * * * *